US007587872B2

(12) United States Patent
Kodi

(10) Patent No.: US 7,587,872 B2
(45) Date of Patent: Sep. 15, 2009

(54) TELESCOPING CHAIR FOR SUPPORTING BARS

(75) Inventor: Jon R. Kodi, Lebanon, TN (US)

(73) Assignee: Kodi Klip Corporation, Lebanon, TN (US)

( * ) Notice: Subject to any disclaimer, the term of this patent is extended or adjusted under 35 U.S.C. 154(b) by 0 days.

(21) Appl. No.: 11/782,092

(22) Filed: Jul. 24, 2007

(65) Prior Publication Data

US 2008/0184652 A1 Aug. 7, 2008

Related U.S. Application Data

(60) Provisional application No. 60/899,525, filed on Feb. 5, 2007.

(51) Int. Cl.
*E04B 2/82* (2006.01)
*E04B 9/00* (2006.01)
*E04H 12/00* (2006.01)

(52) U.S. Cl. ..... 52/649.1; 52/126.1; 52/126.6

(58) Field of Classification Search ..... 52/649.1, 52/126.1, 126.6; 248/125.3, 159, 415, 521, 248/349.1
See application file for complete search history.

(56) References Cited

U.S. PATENT DOCUMENTS

| | | | | | |
|---|---|---|---|---|---|
| 1,852,673 | A | | 4/1932 | Pilj | |
| 1,986,528 | A | | 1/1935 | Ranger | 72/122 |
| 2,551,826 | A | | 5/1951 | Cox, Sr. | 72/122 |
| 2,571,337 | A | | 10/1951 | Burnham | 61/48 |
| 2,879,087 | A | | 3/1959 | Haglund | 287/54 |
| 3,006,115 | A | * | 10/1961 | Hillberg | 52/365 |
| 3,216,752 | A | | 11/1965 | Rifken | 287/54 |
| 3,338,605 | A | * | 8/1967 | Stoeber | 403/174 |
| 3,360,883 | A | | 1/1968 | Glanzer | 46/29 |
| 3,379,401 | A | * | 4/1968 | Pellegrino | 248/407 |
| 3,471,968 | A | * | 10/1969 | Letz | 47/47 |
| 3,602,471 | A | * | 8/1971 | Reed, III | 248/156 |
| 3,788,025 | A | | 1/1974 | Holmes | 52/685 |
| 4,060,954 | A | | 12/1977 | Liuzza | 52/677 |
| 4,080,770 | A | | 3/1978 | Vigh | 52/689 |
| 4,110,951 | A | | 9/1978 | Padrun | 52/686 |
| 4,136,984 | A | | 1/1979 | Hayashi | 403/170 |
| 4,136,985 | A | | 1/1979 | Taul | 403/172 |
| 4,141,526 | A | * | 2/1979 | John | 248/352 |
| 4,214,841 | A | | 7/1980 | Hayashi | 403/188 |
| 4,440,519 | A | | 4/1984 | Pennel et al. | 403/391 |
| 4,482,088 | A | | 11/1984 | Hyun | 227/67 |
| 4,511,073 | A | | 4/1985 | Furutsu | 227/67 |

(Continued)

FOREIGN PATENT DOCUMENTS

| | | |
|---|---|---|
| JP | 4108944 | 4/1992 |

(Continued)

*Primary Examiner*—Richard E Chilcot, Jr.
*Assistant Examiner*—Andrew J Triggs
(74) *Attorney, Agent, or Firm*—Waddey & Patterson, P.C.; Lucian Wayne Beavers

(57) ABSTRACT

A chair for supporting bars is comprised of telescoping sections which lock in an extended position. The chair is intended for supporting the reinforcing bars utilized in reinforced concrete construction, but can also support other long bodies. The sections of the chair can be extended and locked individually, so the height of the chair is determined by which sections of the chair are extended and which sections are collapsed.

15 Claims, 3 Drawing Sheets

U.S. PATENT DOCUMENTS

| | | | | |
|---|---|---|---|---|
| 4,598,523 | A * | 7/1986 | Tolliver | 52/685 |
| 4,610,122 | A | 9/1986 | De Clercq | 52/719 |
| 4,617,775 | A | 10/1986 | Padrun | 52/684 |
| 4,800,702 | A | 1/1989 | Wheeler | 52/677 |
| 4,835,933 | A | 6/1989 | Yung | 52/685 |
| 4,991,372 | A | 2/1991 | Sonneville | 52/685 |
| 5,370,293 | A | 12/1994 | Bevins | 227/63 |
| 5,371,991 | A | 12/1994 | Bechtel et al. | 52/686 |
| D355,582 | S | 2/1995 | Sleight | D8/354 |
| 5,518,399 | A | 5/1996 | Sicurelli, Jr. et al. | 433/220 |
| 5,588,554 | A | 12/1996 | Jones | 221/88 |
| 5,595,039 | A | 1/1997 | Lowery | 52/677 |
| 5,626,436 | A | 5/1997 | Dragone | 403/400 |
| 5,683,025 | A | 11/1997 | Grendol | 227/67 |
| 5,697,591 | A | 12/1997 | Cooper | 248/229.16 |
| 5,752,297 | A | 5/1998 | Ramey | 24/462 |
| 5,826,629 | A | 10/1998 | West | 140/119 |
| 5,881,452 | A | 3/1999 | Nowell, III et al. | 29/816 |
| 5,893,252 | A | 4/1999 | Hardy et al. | 52/685 |
| 6,148,488 | A | 11/2000 | Gristock | 24/462 |
| 6,276,108 | B1 | 8/2001 | Padrun | 52/684 |
| 6,354,054 | B1 | 3/2002 | Verelli et al. | 52/686 |
| 6,371,763 | B1 | 4/2002 | Sicurelli, Jr. et al. | 433/220 |
| 6,442,906 | B1 * | 9/2002 | Hwang | 52/126.6 |
| 6,513,555 | B1 | 2/2003 | Lesser et al. | 140/123.6 |
| 6,572,064 | B1 * | 6/2003 | Letson et al. | 248/349.1 |
| 6,585,142 | B1 | 7/2003 | Chen | 227/130 |
| 6,672,498 | B2 | 1/2004 | White et al. | 227/120 |
| 6,725,535 | B2 | 4/2004 | Edson et al. | 29/809 |
| 6,857,246 | B2 | 2/2005 | Erbetta et al. | 52/653.2 |
| 6,915,624 | B2 | 7/2005 | Shibazaki et al. | 53/588 |
| 6,925,698 | B2 | 8/2005 | Goodsmith et al. | 29/432.1 |
| 6,971,515 | B2 | 12/2005 | Cooper et al. | 206/343 |
| 6,983,570 | B2 * | 1/2006 | Mead | 52/263 |
| 7,003,860 | B2 | 2/2006 | Bloch et al. | 29/407.1 |
| 7,086,203 | B2 * | 8/2006 | Owen | 52/126.6 |
| D529,794 | S | 10/2006 | Murray | D8/396 |
| 7,147,209 | B2 | 12/2006 | Jones et al. | 254/25 |
| D534,418 | S | 1/2007 | Minor et al. | D8/396 |
| 2001/0034987 | A1 * | 11/2001 | Cooper et al. | 52/220.8 |
| 2003/0033760 | A1 * | 2/2003 | Rogers et al. | 52/167.7 |
| 2003/0089049 | A1 * | 5/2003 | Scissom et al. | 52/126.1 |
| 2003/0154579 | A1 | 8/2003 | Disher | 24/462 |
| 2004/0035064 | A1 * | 2/2004 | Kugler et al. | 52/126.6 |
| 2004/0040247 | A1 | 3/2004 | Morse | 52/649.8 |
| 2004/0074170 | A1 * | 4/2004 | Huang | 52/220.1 |
| 2004/0088945 | A1 * | 5/2004 | Owen | 52/677 |
| 2004/0154261 | A1 | 8/2004 | Miller | 52/719 |
| 2004/0261352 | A1 | 12/2004 | Bennett et al. | 52/698 |
| 2005/0217198 | A1 | 10/2005 | Carraher et al. | 52/719 |
| 2008/0184652 | A1 * | 8/2008 | Kodi | 52/649.1 |

FOREIGN PATENT DOCUMENTS

| | | | |
|---|---|---|---|
| WO | 9001600 | A1 | 2/1990 |
| WO | WO 9001600 | A1 * | 2/1990 |
| WO | 9428265 | | 12/1994 |
| WO | WO 9428265 | A1 * | 12/1994 |

* cited by examiner

TELESCOPING CHAIR FOR SUPPORTING BARS

CROSS-REFERENCES TO RELATED APPLICATIONS

This application is a Non-Provisional Utility application which claims benefit of co-pending U.S. Patent Application Ser. No. 60/899,525 filed Feb. 5, 2007, entitled "Telescoping Chair For Supporting Bars" which is hereby incorporated by reference.

BACKGROUND OF THE INVENTION

1. Field of the Invention

Reinforced concrete construction frequently utilizes reinforcing bars suspended within the concrete. Often these bars are suspended on chairs at specified heights. The present invention relates generally to a chair for suspending bars within reinforced concrete. The chair can be used to support reinforcing bars as well as other long bodies, such as pipes, ducting or conduit.

2. Description of the Prior Art

Reinforced concrete construction has been around for many years. Reinforcing bars are embedded in the concrete to improve the strength of the final concrete. Concrete has a very high compressive strength, but the tensile strength is improved significantly by utilizing reinforcing bars within the concrete. These reinforcing bars are typically suspended at a specified height which varies from one job to the next depending on the concrete specifications for each job. In the past, metal chairs have been used to support the bars; however metal chairs have many disadvantages. Metal at the bottom of the chair is exposed and provides an initiation point for rust. This rusting causes the chairs to expand because the metal oxide takes up a larger volume than the metal. As the rusting chair expands, the concrete cracks and the concrete structure is weakened.

There are many chair designs in existence today. For example, Liuzza, in U.S. Pat. No. 4,060,954, discloses a base plate with lugs for receiving the legs of a chair. The height of the support is varied by stacking one chair on another. In a stack of these chairs, bars can be supported on each chair so that bars can be simultaneously supported at several different elevations within the stack of chairs.

Vigh, in. U.S. Pat. No. 4,080,770, discloses a plastic base and a metal wire spacer. The metal wire spacer is received in the plastic base. The plastic base may have tabs which can be used to secure the base to a substructure. The bars are supported at different heights by inserting different size wire spacers into the plastic base.

U.S. Pat. No. 4,835,933 by Yung discloses a support that has a base and a central vertical post that ends in a saddle, wherein the saddle is adapted for receiving a bar. A separate clamp member has arms and is received in holes in the saddle, wherein these holes are beside the central post. The arms of the clamp member hold the first bar and hooks in the clamp member hold the second bar transverse to the first bar. Different size supports are used to hold bars at different heights, and small adjustments can be made by placing an extender on top of the saddle portion of the support.

Lowery, in U.S. Pat. No. 5,595,039, discloses another chair. This chair has a base and a cap which are connected by a stem. The stem can be rebar, which is available at most job sites. The cap has a slot for holding the reinforcing bar and the height of the support can be adjusted by cutting the stem to the desired size. Thus, the stem can be cut at the job site to position the bar at the correct height.

Verelli et al., in U.S. Pat. No. 6,354,054, discloses a rebar chair with a body and four legs below the body. Two transverse bars are received between the four legs and are wired to the body or are supported on another chair of a different design placed between the legs. At least a third bar can be received in a saddle on top of the body.

U.S. Patent Published Application Number 2004/0261352 A1 by Bennett et al. discloses a support chair with a tapered body and a plurality of legs. The body is generally tapered so that the legs get further apart as they get lower, and there are notches on top of the body to hold transverse bars. The body is designed so additional chairs can be stacked on top of the supporting chair to adjust the height at which the bars are supported.

Screed supports are also used in concrete construction to level a concrete slab. Pilj, in U.S. Pat. No. 1,852,673 discloses a screed support which has a post and a separate support section. The post is driven into an underlying base, and the support section is attached to the post. The height of the support is adjusted by attaching the support at different positions on the post. The support is adapted to receive a leveling device for leveling the concrete.

Another screed support is disclosed by Cox in U.S. Pat. No. 2,551,826. Cox describes a post with a bottom portion which is adapted to be attached to an underlying base. The bottom of this post is pointed and threaded so that it can be screwed into the underlying base. A separate saddle has a sleeve which is slid over the top of the post. The height of the saddle is determined by sliding a nail through nail holes in the sleeve wherein the nail is engaged in notches in the post. The saddle is adapted to receive a leveling device.

Hillberg, in U.S. Pat. No. 3,006,115, describes another screed support. This screed support also has two parts. The first is a base which supports a socket and the second part is a cradle. The cradle has a threaded shank with an adjusting nut. The shank fits into the socket and the height of the cradle is set by the adjusting nut which abuts the socket. The cradle is adapted to receive a straight edge or a bar for leveling the concrete.

BRIEF SUMMARY OF THE INVENTION

The current invention comprises a chair for supporting bars in concrete. The chair is comprised of a series of concentric telescoping sections which lock when telescoped to an extended position. Each section is locked independent of the others so that if the chair had three sections, the top section could be extended and locked in place while the intermediate section remained collapsed relative to the bottom section.

Three embodiments of the lock are described. The first consists of a protrusion and a J slot. The protrusion is defined in a first section and the J slot is received in a second section wherein the first and second sections are adjacent so that one extends from the other. The protrusion is engaged in the J slot and as the sections are extended the protrusion slides up and finally catches in the end of the J slot. The end of the J slot forms a catch point and when the chair is upright, gravity pushes the protrusion into the catch point, thus locking the sections in an extended position.

A second embodiment of the lock is comprised of a detent and indentation. The detent is defined in a first section and the indentation is in a second, adjacent section. When the sections are extended relative to each other, the detent engages the indentation so as to lock the sections in the extended position.

The third embodiment of the lock comprises a spring tab defined in a first section and a window defined in a second section. The spring tab engages the window when the sections are extended relative to each other, so the sections lock in the extended position.

There is also a retaining ring which is attached near the top of the top section. This helps to keep the sections together so they do not fall apart before being positioned. The top section has a seat defined in it for receiving the bar, and the bottom section has a base extending horizontally to increase the stability of the chair.

The current invention provides several advantages to the user, such as the need for only one chair to support a bar at a variety of heights. This allows the store room to only stock one chair, which reduces inventory and thereby lowers cost. The chair is also very easy to use and the height can be adjusted in the field when the bars are being supported.

DETAILED DESCRIPTION OF THE INVENTION

Figure 1:
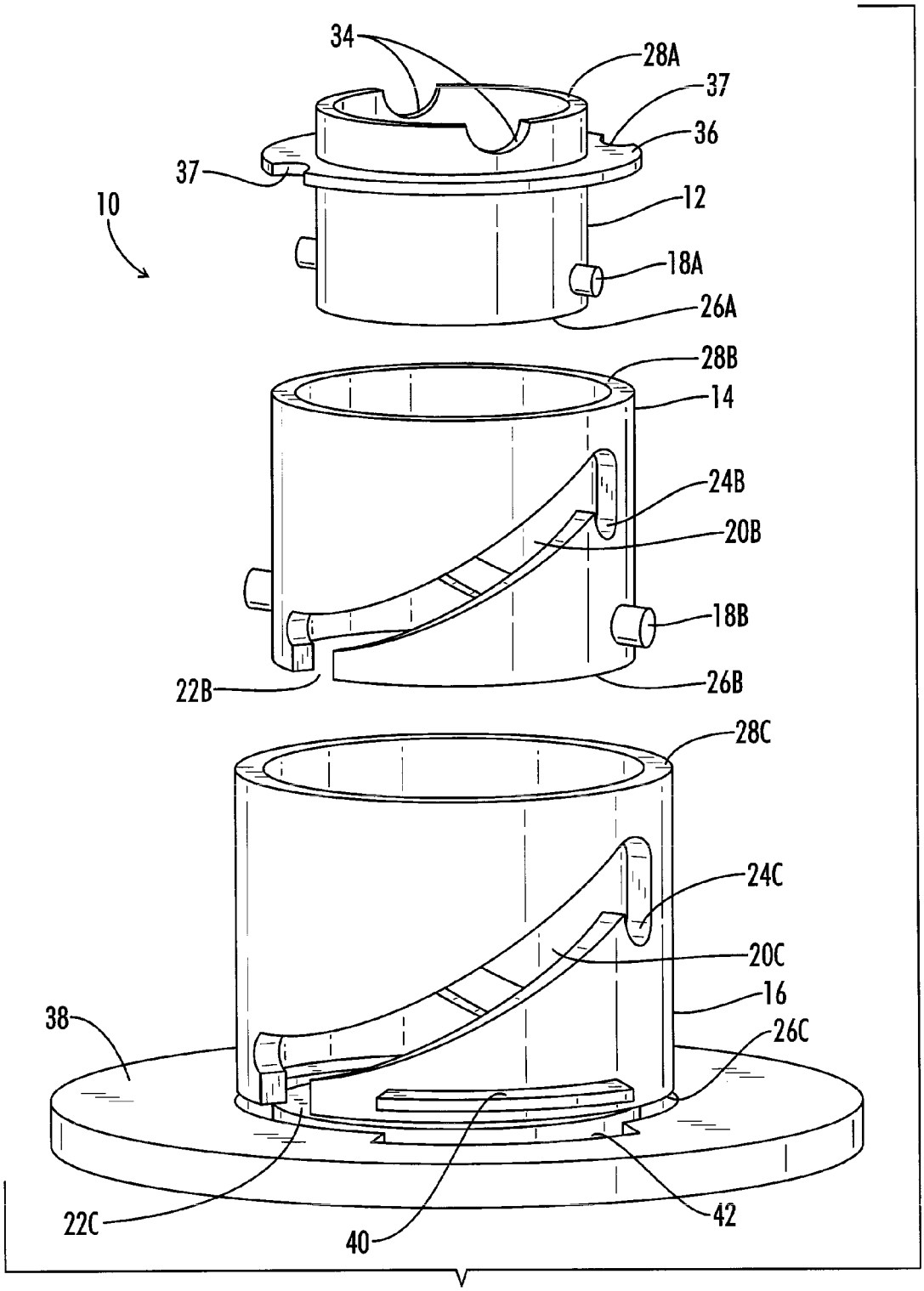
FIG. 1 is an exploded perspective view of the chair with the J slot lock.

The preferred embodiment of the chair 10 is shown in an exploded perspective view in FIG. 1. The chair 10 is comprised of concentric sections which telescope between a collapsed position and an extended position. In the preferred embodiment, three sections are utilized, including a top section 12, an intermediate section 14, and a bottom section 16. The top section 12 is received in the intermediate section 14, which is received in the bottom section 16 so that all three sections are received together one after the other. It is also possible that the chair 10 comprise only top and bottom sections 12, 16, or more than three sections with a plurality of intermediate sections 14, as needed.

Generally, the chair 10 is used to support bars that are to be encased in concrete, so the chair 10 is also encased for the life of the concrete. Chairs 10 are placed under the lowest bars which become the supporting bars. Crossing bars are then placed on top of the supporting bars, and are supported by the supporting bars. Of course, more than just the lowest bars could be supported, up to all of the bars used, as needed. The chair 10 is comprised of plastic, which does not provide an access point for rust to begin in the concrete. This helps to sustain the soundness and strength of the concrete over a longer period than if a metal support were used.

In the preferred embodiment the sections all have a common axis, and the axis is vertical when the chair is upright. Each section can be extended independent of the others so that the top section 12 could be extended relative to the intermediate section 14 at the same time that the intermediate section 14 was collapsed relative to the bottom section 16. It is just as possible to have every section extended or every section collapsed. So, the height at which the chair 10 supports a bar depends on which sections are extended.

Preferentially, the shape of each section is cylindrical. Depending on the type of lock used, the sections could also be squares, rectangles, ovals or almost any other shape which is able to extend or telescope relative to an adjacent shape. To effectively support a bar at a variety of heights, the sections have to lock when extended relative to each other. Therefore, the chair 10 has at least one lock, and preferentially a plurality of locks, such that the sections lock in the extended position. Of course, there is at least one lock for each extending section.

Three embodiments of the locks utilized are described. The first embodiment comprises protrusions 18A and 18B which are received in J slots 20B and 20C. Similar components on different sections are given different suffixes for clarity, with the top section having the suffix A, the intermediate section having the suffix B, and the bottom section having the suffix C. Therefore, the top section protrusion is designated as 18A, and the intermediate section protrusion is designated as 18B. Each telescoping portion of the chair 10 involves a first and a second section, where one of the sections extends relative to the other section. The extending section can be either the first or the second section wherein the supporting section is the other section. Therefore the intermediate section 14 could serve as a supporting section for the top section 12, and at the same time the intermediate section 14 could serve as an extending section for the bottom section 16. Throughout this disclosure the terms first and second sections, or alternatively the extending and supporting sections, are used to refer to any two adjacent sections. The J slot is also referred to as the slot. The embodiments of the lock are described for the top and intermediate sections, but apply to all the sections.

In the preferred embodiment at least one protrusion 18A, and preferably two, are defined in each extending section. At least one J slot 20B, and preferably two, are defined in each supporting section such that the J-slot 20B receives the protrusion 18A of the extending section. One end of the J slot 20B comprises an opening 22B wherein the other end comprises a catch point 24B. Preferentially, the opening 22B is received at the bottom end of the supporting section 26B. The catch point 24B is angled such that the protrusion 18A is urged into the catch point 24B when the protrusion 18A is engaged in the catch point 24B and the chair 10 is upright. Gravity serves as the force which urges the protrusion 18A into the catch point 24B. When the protrusion 18A and J slot 20B locking mechanism is used, the sections comprise cylinders to allow the extending section to rotate in the supporting section. As the extending section is extended the protrusion 18A remains engaged in the J slot 20B, which requires the sections to rotate within each other.

During assembly, the top section 12 is inserted into the intermediate section 14 from the bottom such that the protrusion 18A engages the J slot 20B. Then the intermediate section 14 is inserted into the supporting bottom section 16 from the bottom, again with the protrusion 18B engaging the J slot 20C. The J slot opening 22B is on the bottom end 26B of the supporting section. The opening 22B provides a location where the protrusion 18A can be introduced into the J slot 20B when the sections are assembled. As can be seen, the J slot 20B and protrusion 18A could be reversed, so the protrusion 18A was in the supporting section and the J slot 20B was in the extending section. If the J slot 20B were in the extending section, the J slot opening 22B would be in the top end 28B of the sections having the J slots. Regardless of which section has the protrusion 18A and the J slot 20B, the top or extending section 12 is introduced to the intermediate or supporting section 14 from the bottom during assembly.

It is also possible to construct the chair 10 with the bottom section 16 being smaller and received inside the intermediate section 14. Then the top section 12 would be even larger and the intermediate section 14 would be received inside the top section 12. The locking function would still operate in the same manner.

Figure 2:
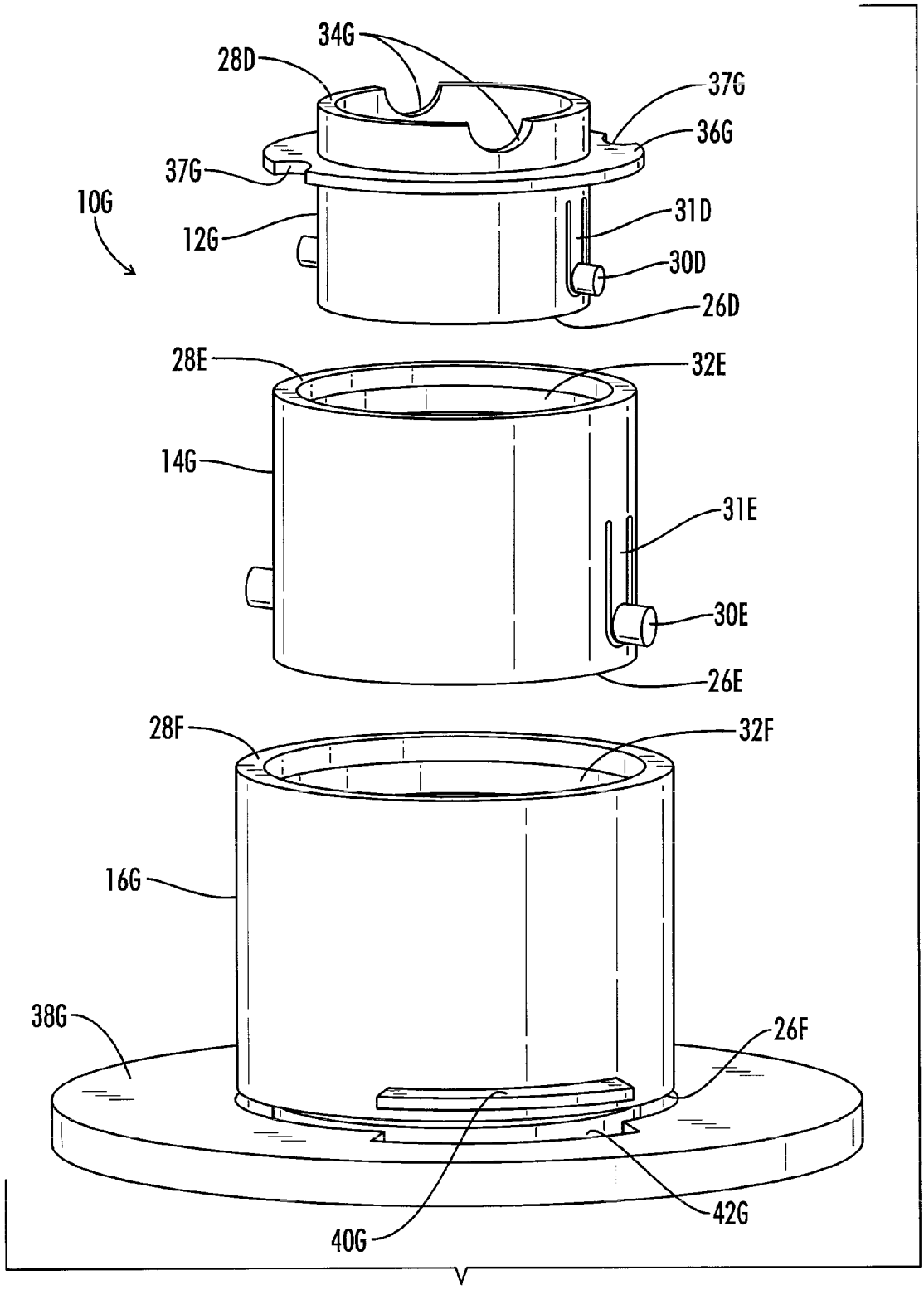
FIG. 2 is an exploded perspective view of the chair with the detent lock.

A second embodiment of the lock comprises detents 30D, 30E and indentations 32E, 32F as shown in FIG. 2. In the second embodiment, the top section is designated by the suffix D, the intermediate section by the suffix E, and the bottom section by the suffix F, similar to the first embodiment. The components in the embodiment shown in FIG. 2 are distinguished from similar components in the embodiment shown in FIG. 1 by the suffix G when the suffix of D, E, or F is not appropriate, so the chair in FIG. 2 is labeled 10G. The detent 30D is the projection which is received in the associated indentation 32E. The detent 30D is defined in a first section, and the indentation 32E is defined in a second section such that the detent 30D engages the indentation 32E when the sections are extended relative to each other. This serves to lock the sections in the extended positions. In the preferred embodiment, the sections are cylinders, and each extending section has two detents 30D. The supporting sections have one indentation 32E going all the way around on the inside.

When the detent 30D and indentation 32E lock system is used, the sections could be a variety of shapes. They could be square, oval, rectangular or any other shape which is able to slide up and down within an adjacent shape. There is no need for the detent 30D to engage the indentation 32E until the sections are completely extended, so the sections don't need to rotate within one another. Therefore, there is no need for cylindrical shaped sections. If a non-cylindrical shape were used, there would be one indentation 32E positioned above each detent 30D so the sections would lock when extended. For any shape used, there could be any number of detents for each locking section.

The detent 30D is constructed such that it can be released from the indentation 32E if desired. The detent 30D is on the end of a finger 31D which urges the detent 30D into the indentation 32E. By pressing in on the finger 31D, the detent 30D can be disengaged from the indentation 32E, which allows a section to be collapsed after it has been locked in the extended position.

Figure 3:
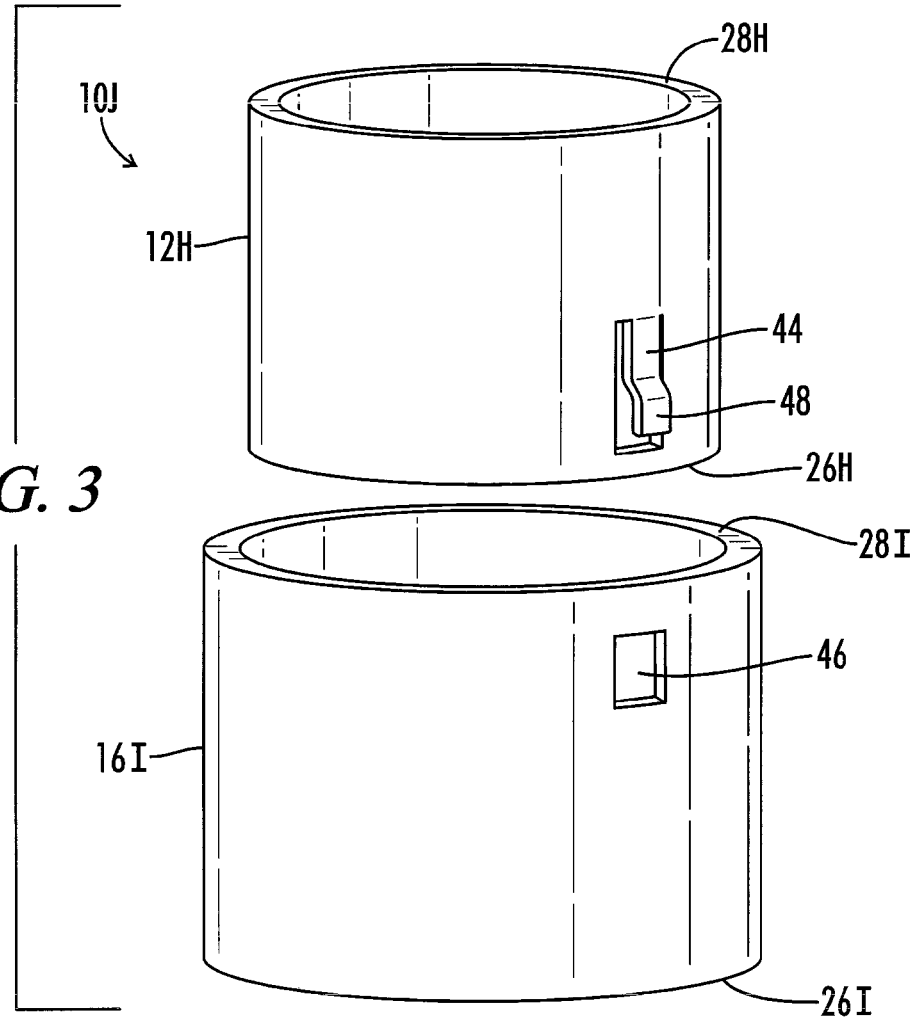
FIG. 3 is an exploded perspective view of the chair with the spring tab lock.
Figure 4:
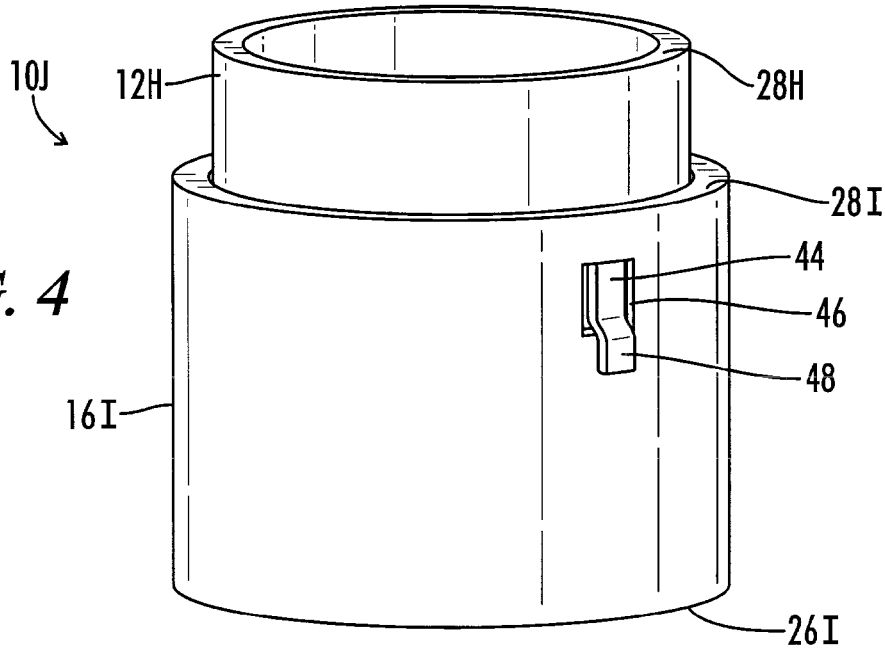
FIG. 4 is a perspective view of the chair with the spring tab lock in the locked position.

The third embodiment of the lock comprises a spring tab 44 defined in the top section 12H and a window 46 defined in the bottom section 161, as shown in FIGS. 3 & 4. Comparable components in FIGS. 3 & 4 are designated by the suffix J, with the top section components having the suffix H and the bottom section components having the suffix I, as described for the detent lock system. Preferably, each extending section is secured by two spring tab locks, but any number of locks are possible.

The spring tab 44 engages the window 46 and locks the sections when extended relative to each other. The spring tab 44 naturally sits in the position held when engaged with the window 46, so the resiliency of the spring tab 44 presses outward when the spring tab 44 is held inside of the bottom section 16I. The window 46 passes completely through the bottom section 16I, so the spring tab 44 is accessible from outside the bottom section 16I when the sections are locked. In the preferred embodiment, the spring tab 44 has a step 48 to more securely engage the window 46. In the locked position, the step 48 extends below the window 46 on the outside surface of the bottom section 16I. Once locked, the sections 12H, 16I can be unlocked by pulling the top section 12H upwards until the step 48 no longer extends below the window 46, then pressing the spring tab 44 and step 48 inward past the inner surface of the bottom section 16I, and then pushing the top section 12H down.

As with the detent lock, the position of the spring tab 44 and the window 46 could be reversed, with the spring tab 44 in the bottom section 16I and the window 46 in the top section 12H. The sections could be a variety of shapes, and there could be more than two sections. For both the spring tab and detent lock system, inserting extending sections into supporting sections from the bottom simplifies assembly by avoiding engagement of the lock.

To more securely receive a bar, the chair 10 has a seat 34 defined at the top end 28A of at least one section, as shown in FIG. 1. Of course, the seat 34 can also receive conduit, tubing, or other generally rod-shaped objects. Preferentially, the seat 34 comprises two concave recesses adapted to receive a reinforcing bar. These concave recesses are on opposite sides of the top end 28A of the top section 12. It is also possible that the seat 34 would comprise concave recesses received on more than just the top section 12. In fact, the seat 34 could be defined in the top end of every section 28A, 28B, and 28C. The recesses would have to be aligned when the sections were collapsed so that the bar would fit into all of the recesses at one time. As each section was extended, the recesses would be available at the top of the chair 10. It is also possible for the seat 34 to be something other than concave recesses, such as fingers extending upwards from the top end 28A of a section to hold the bar.

In the preferred embodiment the seat 34 comprises concave recesses in only the top section 12. In this case, the top section 12 always has to be the highest section when the chair 10 is upright. A retaining ring 36 insures the top section 12 is the highest section. The retaining ring 36 is connected near the top end of the top section 28A, just below the seat 34. The retaining ring 36 is dimensioned to abut the intermediate and bottom sections 14, 16 so that the top end of the top section 28A is always higher than the other sections. Keeping the seat 34 above the other sections prevents the intermediate and bottom sections 14, 16 from interfering with the placement of the bar in the seat 34.

A second purpose of the retaining ring 36 is to prevent the sections from separating. The distance from the retaining ring 36 to the top section protrusion 18A is less than the distance from the top end 28B to the bottom end 26B of the intermediate section 14. Because the retaining ring 36 abuts the top end of the intermediate section 28B, the protrusion 18A has to remain engaged in the J slot 20B, and the sections cannot separate. After the top section 12 is introduced into the intermediate section 14 from the bottom, and the rest of the chair 10 is similarly assembled, the retaining ring 36 is attached to the top section 12. The retaining ring 36 can be a wide variety of shapes, as long as it abuts the intermediate and bottom sections 14, 16. Also, the retaining ring 36 can be connected to the top section by any appropriate means, such as a tab and groove or glue. The retaining ring 36 includes at least one, and preferably two, finger notches 37 to facilitate handling. The finger notches 37 are defined in the retaining ring 36, and are dimensioned to receive a human finger.

A base 38 is used to stabilize the chair 10. The base 38 is connected at the bottom end of the bottom section 26C. The base 38 is perpendicular to the central axis of the sections, so that when the chair 10 is upright, the base 38 is horizontal. The base 38 can be connected to the bottom section 16 by any appropriate means, including a tab 40 and groove 42, wherein the tab 40 is inserted into the groove 42 and then rotated to a locked position. The base 38 can be any of a variety of shapes. It can be a round disk, or a plurality of legs extending from the bottom section 16, or any other shape which would provide support to the chair 10. The base 38 can extend inside of the bottom section 16 by passing under the bottom end 26C, or it can just be attached to the outer surface of the bottom section 16. If the base extended under the bottom end of every section 26A, 26B, and 26C, it could be utilized to prevent the chair 10 from coming apart by preventing the extending sections from falling out of the bottom of the supporting sections.

The current invention also includes a method for supporting a bar. This method includes providing the chair 10 as described above, and extending the chair 10 to an extended height as desired. The chair 10 is then locked in the extended height and positioned below the bar to be supported. The seat 34 defined in the chair 10 is engaged with the bar when the chair 10 is positioned below the bar. Finally, the bar is supported at the extended height by the chair 10 underneath the bar. The chair 10 is stabilized by the base 38 which extends from the bottom section 16 of the chair 10. The sections can be locked in an extended position by engaging a protrusion 18A defined in one section with a slot catch point 24B defined in anther section.

Thus, although there have been described particular embodiments of the present invention of a new and useful Telescoping Chair for Supporting Bars, it is not intended that such references be construed as limitations upon the scope of this invention except as set forth in the following claims.

What is claimed is:

1. A chair for supporting a bar comprising:

at least a first and a second section having top and bottom ends, wherein one section is received in the other section such that the sections telescope between a collapsed position and an extended position;

a lock between the first and second sections such that the sections lock in the extended position wherein the lock further comprises:

at least one protrusion defined on the first section; and at least one J-slot defined in the second section, the protrusion being received in the J-slot wherein the J-slot is oven to the bottom end of the second section, and wherein the first section is received in the second section; and a seat adapted to receive the bar, the seat being defined at the top end of at least one of the sections.

2. The chair of claim 1 wherein the seat further comprises two concave recesses defined in the top end of one of the sections.

3. The chair of claim 1 further comprising a base connected to the bottom end of one of the sections.

4. The chair of claim 1 further comprising a retaining ring connected to the first section, the retaining ring being dimensioned to abut the second section, so the retaining ring prevents the sections from separating.

5. The chair of claim 4 wherein the retaining ring includes a finger notch.

6. The chair of claim 1 wherein the chair is comprised of plastic.

7. A chair for supporting a bar comprising:

a top section, a bottom section, and at least one intermediate section, wherein the sections are received in each other such that the sections telescope between a collapsed position and an extended position;

a plurality of locks, such that the sections lock in the extended position;

a seat defined on at least the top section; and a retaining ring attached to the toy section, the retaining ring being dimensioned to abut the bottom section.

8. The chair of claim 7 further comprising a base connected to the bottom section.

9. The chair of claim 7 wherein:

the top section and the intermediate section are received one in the other; and wherein one of the plurality of locks comprises:

at least one protrusion defined on one of the top section and the intermediate section; and at least one slot defined in the other of the top section and the intermediate section wherein the protrusion is engaged in the slot.

10. The chair of claim 7 wherein the retaining ring further comprises a finger notch.

11. The chair of claim 7 wherein each lock further comprises a detent and an indentation.

12. The chair of claim 7 wherein each lock further comprises a spring tab and a window.

13. The chair of claim 7 wherein the chair is comprised of plastic.

14. A chair for supporting a bar comprising:

a top section, a bottom section, and at least one intermediate section, wherein the top section is telescopingly received within the at least one intermediate section, and the at least one intermediate section is telescopingly received within the bottom section, such that the sections telescope between a collapsed position and an extended position;

a first lock between the top section and the at least one intermediate section, the first lock arranged to lock the top section in an extended position relative to the at least one intermediate section;

a second lock between the at least one intermediate section and the bottom section, the second lock arranged to lock the at least one intermediate section in an extended position relative to the bottom section; and a seat defined on the top section.

15. The chair of claim 14, wherein the first lock further comprises:

at least one protrusion defined on one of the top section and the at least one intermediate section; and at least one slot defined in the other of the top section and the at least one intermediate section wherein the protrusion is engaged in the slot.

* * * * *

UNITED STATES PATENT AND TRADEMARK OFFICE

CERTIFICATE OF CORRECTION

PATENT NO. : 7,587,872 B2
APPLICATION NO. : 11/782092
DATED : September 15, 2009
INVENTOR(S) : Jon R. Kodi It is certified that error appears in the above-identified patent and that said Letters Patent is hereby corrected as shown below:

Column 5, line 40, replace "161" with --16I--.
Column 7, line 33, replace "oven" with --open--.
Column 8, line 6, replace "toy" with --top--.

Signed and Sealed this

Third Day of November, 2009

David J. Kappos

David J. Kappos
*Director of the United States Patent and Trademark Office*